United States Patent [19]

Haufe et al.

[11] Patent Number: 4,948,424

[45] Date of Patent: Aug. 14, 1990

[54] LOW VOLTAGE SWITCHING APPARATUS SINTER CONTACT MATERIAL

[75] Inventors: Wolfgang Haufe, Hessdorf; Bernard Rothkegel, deceased, late of Nuremberg, both of Fed. Rep. of Germany, by Rita G. Rothkegel, Bianca Rothkegel and Matthias Rothkegel, heirs.

[73] Assignee: Siemens Aktiengesellschaft, Berlin & Munich, Fed. Rep. of Germany

[21] Appl. No.: 438,514

[22] Filed: Nov. 17, 1989

[30] Foreign Application Priority Data

Nov. 17, 1988 [DE] Fed. Rep. of Germany ..... 3838951

[51] Int. Cl.[5] ..... C22L 29/12

[52] U.S. Cl. ..... 75/234; 252/514; 419/21; 419/22

[58] Field of Search ..... 75/234; 252/514; 419/21, 22

[56] References Cited

U.S. PATENT DOCUMENTS

| | | | |
|---|---|---|---|
| 3,963,449 | 6/1976 | Seki et al. | 29/182.5 |
| 4,141,727 | 2/1979 | Shida et al. | 75/232 |
| 4,294,616 | 10/1981 | Kim et al. | 75/234 |
| 4,681,702 | 6/1987 | Schreirer et al. | 252/518 |
| 4,764,227 | 8/1988 | Rothkegel et al. | 148/431 |

FOREIGN PATENT DOCUMENTS

| | | |
|---|---|---|
| 3304637 | 8/1984 | Fed. Rep. of Germany . |
| 3421758 | 12/1985 | Fed. Rep. of Germany . |
| 3421759 | 12/1985 | Fed. Rep. of Germany . |

*Primary Examiner*—Stephen J. Lechert, Jr.
*Assistant Examiner*—Leon Nigohosian, Jr.
*Attorney, Agent, or Firm*—Kenyon & Kenyon

[57] ABSTRACT

Sinter contact materials produced from an intraoxidized alloy powder having the constitution $AgSnO_2Bi_2O_3$-CuO have added thereto at least zirconium oxide and optionally additionally bismuth oxide in parts by weight of preferably between 0.1 and 5%. For the production of these materials, zirconium oxide power and optionally additionally bismuth oxide powder is added to the intraoxidized alloy powder $AgSnO_2Bi_2O_3CuO$. With such a contact material, the excess temperature behavior in motor contactors is improved.

19 Claims, No Drawings

LOW VOLTAGE SWITCHING APPARATUS SINTER CONTACT MATERIAL

FIELD OF THE INVENTION

This invention relates to a sinter contact material for low voltage switching apparatus of the energy technology, in particular for motor contactors, containing silver (Ag), tin oxide ($SnO_2$), bismuth oxide ($Bi_2O_3$), and copper oxide (CuO), and produced from an intraoxidized alloy powder (IOAP) of the metals silver, tin, bismuth, and copper. The tin oxide is present in parts by weight of 4 to 12% and the ratio of the parts by weight of tin oxide to bismuth oxide, on the one hand, and of tin oxide to copper oxide in the intraoxidized alloy powder, on the other hand, is in each instance between 8:1 and 12:1.

BACKGROUND OF THE INVENTION

Contact materials based on silver-tin oxide have proven to be particularly advantageous for use in low voltage switching apparatus of the energy technology, for example in motor contactors and also in power switches. Contact pieces of silver-tin oxide in motor contactors have a high lifetime number of operations, but have the disadvantage that, under the influence of arcing, oxide layers form on the contact surfaces which are thermally very stable leading to increased contact resistance. Therefore, when carrying continuous current in the switching apparatus, unacceptably high excess temperatures occur at the switching members which can lead, in particular, to damage at the synthetic parts.

In DE-OS No. 33 04 637, No. DE-OS 34 21 758, and DE-OS No. 34 21 759, sinter contact materials having the constitution $AgSnO_2Bi_2O_3CuO$ are described which, on the one hand, meet the requirements made for lifetime number of operations and, on the other hand, of switching-on capacity. In these materials, a relatively high bismuth oxide fraction can be present which is introduced either via the intraoxidized alloy powder or via a separate addition of bismuth oxide to the intraoxidized alloy powder. However, these materials reach acceptable values with respect to excess temperature only if the total parts by weight of the oxide is limited to 8% to 11%.

OBJECT OF THE INVENTION

It is therefore an object of the present invention to provide a material produced from intraoxidized alloy powder having the constitution $AgSnO_2Bi_2O_3CuO$ wherein for the purpose of saving silver, the oxide fraction is as high as possible, and also the excess temperature is as low as possible, and wherein the remaining properties are still in an optimal relationship to each other.

These and other objects of the present invention will become apparent from the description and claims.

SUMMARY OF THE INVENTION

According to the present invention, a contact material of the intraoxidized alloy powder of the $AgSnO_2$-$Bi_2O_3CuO$ type discussed under the heading Field of the Invention further contains at least zirconium oxide ($ZrO_2$). The parts by weight of the zirconium oxide therein is suitably between 0.1 and 5%, preferably 0.5 to 4%, more preferably 0.5 to 3%, and still more preferably 0.5 to 2%. Optionally, bismuth oxide can be present in addition to the bismuth oxide of the intraoxidized alloy powder outside the compound powder particles. The parts by weight of the optional bismuth oxide is suitably between 0.1 and 5%, preferably 0.5 to 4%, or more preferably 0.5 to 3%. The parts by weight zirconium oxide and additional bismuth oxide in combination may be 0.1 to 5%, 0.5 to 4%, 0.5 to 3%, or 0.5 to 2%. The total content of the oxides in parts by weight is maximally about 20%, suitably between about 12 to 20%.

For the production of such a material, zirconium oxide powder, and optionally bismuth oxide powder, is added to an intraoxidized alloy powder of given composition wherein during wet mixing of the intraoxidized alloy powder with the powder of the added oxide, organic solvents, in particular propanol, are used.

Surprisingly, it was found, in accordance with the present invention, that specifically through the addition of at least zirconium oxide powder to an intraoxidized alloy powder of $AgSnO_2Bi_2O_3CuO$, in particular with total parts by weight of oxide of approximately 12%, lower excess temperatures and comparable or greater lifetime numbers of operation are achieved relative to the state of the art.

Further details and advantages of the invention will be appreciated from the following description of a method for the production of contact pieces of the material of the present invention wherein furthermore reference is made to a Table listing individual examples for various material compositions.

DETAIL DESCRIPTION

In the Table are listed measured values for the lifetime number of operations and for the excess temperature for various material compositions. It is known that the lifetime number of operations corresponds to the volume consumption of the contact material, and the excess temperature to the contact resistance. Four examples of the state of the art and four embodiment examples of the present invention are compared.

For the production of the intraoxidized alloy powders for the examples given in the Table, alloys of AgSnBiCu are melted at a temperature of approximately 1323 K (1050° C.). By atomization of the melt with water in a pressure atomization installation, composite alloy powders are obtained directly therefrom. After drying, the powders are screened to <300 um. This part is quantitatively intraoxidized in an oxygen-containing atmosphere at temperatures between 773 K (500° C.) and 873 K (600° C.) whereupon $AgSnO_2$-$Bi_2O_3CuO$ powder is obtained having the following compositon in parts by weight in percentages:

| Example | Ag | $SnO_2$ | $Bi_2O_3$ | CuO |
|---|---|---|---|---|
| 1 | 88.84 | 9.3 | 0.93 | 0.93 |
| 2/4 | 89.44 | 8.8 | 0.88 | 0.88 |
| 3 | 91.00 | 7.5 | 0.75 | 0.75 |

To the listed $AgSnO_2Bi_2O_3CuO$ powders, the powders of zirconium oxide, and optionally additional bismuth oxide, were added by wet mixing in an agitator ball mill using propanol and steel balls. After drying, the steel balls were separated from the particular powder mixture by screening. The starting powders for the contact piece production of the material examples listed in the Table had the following composition:

| | | |
|---|---|---|
| 1. | $AgSnO_2 9.3\ Bi_2O_3 0.93\ CuO 0.93 + ZrO_2 0.6$ | IOAP-PM |
| 2. | $AgSnO_2 8.8\ Bi_2O_3 0.88\ CuO 0.88 + ZrO_2 1.3$ | IOAP-PM |
| 3. | $AgSnO_2 7.5\ Bi_2O_3 0.75\ CuO 0.75 + ZrO_2 1.4$ | IOAP-PM |
| 4. | $AgSnO_2 8.8\ Bi_2O_3 0.88\ CuO 0.88 + ZrO_2 0.6 + Bi_2O_3 2.4$ | IOAP-PM |

(IOAP = Intraoxidized Alloy Powder PM = Powder Mixture).

In this listing, the intraoxidized alloy powder forms the base with 100 parts by weight in percentages to which the added oxides in parts by weight relative to 100% are added. In the production of the contact pieces, the produced starting powder mixture is compacted with a pressing pressure of, for example, 600 MPa. The obtained pressed pieces are sintered at a temperature between 1123 K (850° C.) and 1148 K (875° C.) for 2 hours in air. To achieve a low residual porosity, the sintered contact pieces are repressed warm at a temperature of 923 K (650° C.) and a pressure of, for example, 1000 MPa. Further compacting and solidification is achieved through a second sintering at a temperature between 1123 K (850° C.) and 1148 K (875° C.) for a period of 2 hours. Subsequently, as a last production step, a cold calibration into the final form takes place at a pressure of, for example, 1000 MPa.

Two-layer finished formed parts with a solderable pure silver layer are advisably manufactured for use as contact pieces in low voltage switching apparatus of the energy technology. These formed pieces can be soldered directly onto the contact carriers, for example, of motor contactors.

With contact pieces produced according to the above procedure, lifetime and heating tests were carried out in motor contactors. Siemens contactors with a nominal AC-3 operating current of 250 A were used. Significant parameters are the lifetime number of operations at the four-fold nominal AC-3 operating current (4 $I_{eAC-3}=1000$ A) and the maximum excess temperature of the connector rails of the switching apparatus when carrying permanently the nominal AC-1 operating current of $I_{eAC-1}=300$ A. Measurements of the excess temperature were carried out during the lifetime test up to a number of operations of $5\times10^4$. The associated measured values are given in the Table.

The four comparison materials of the above discussed state of the art, which were produced by sintering of intraoxidized alloy powders, are listed first. Their values show that with respect to excess temperature, the materials of the constitution $AgSnO_2Bi_2O_3CuO$ and $AgSnO_2Bi_2O_3CuO+Bi_2O_3$ do not reach values below 80 K which, in practice, is in some cases considered unsatisfactory.

The materials of the present invention, which were produced through sintering of an intraoxidized alloy powder of known composition with the addition of zirconimum oxide powder and possibly bismuth oxide powder, in particular with total parts by weight of approximately 12% oxide, yield the required improvement of the excess temperature behavior. Values from 70 K to 80 K were measured. The lifetime number of operations remains on the same high level as the state of the art. The properties of the contact material overall are improved, and, in addition, a saving of silver results.

TABLE

| Example No. | Material | | Lifetime Number of Operations at $4\times I_{eAC-3}=1000$ A | Excess Temperature in K at $I_{eAC-1}=300$ A |
|---|---|---|---|---|
| | | Comparison Material | | |
| DE-OS 33 04 637 | $AgSnO_2 10Bi_2O_3 1CuO 1$ | IOAP | ca. 140,000 | 90–120 |
| DE-OS 34 21 759 | $AgSnO_2 6.5Bi_2O_3 0.66CuO 0.74$ | IOAP | ca. 90,000 | 80–90 |
| DE-OS 34 21 758 | $AgSnO_2 6.47Bi_2O_3 3.51CuO 0.71$ | IOAP | ca. 120,000 | 80–90 |
| | $AgSnO_2 6.33Bi_2O_3 0.64CuO 0.72 + Bi_2O_3 2.63$ | IOAP-PM | ca. 120,000 | 80–90 |
| | | Materials according to the invention | | |
| 1. | $AgSnO_2 9.3Bi_2O_3 0.93\ CuO 0.93 + ZrO_2 0.6$ | IOAP-PM | ca. 146,000 | 70–80 |
| 2. | $AgSnO_2 8.82Bi_2O_3 0.88\ CuO 0.88 + ZrO_2 1.3$ | IOAP-PM | ca. 140,000 | 70–80 |
| 3. | $AgSnO_2 7.5Bi_2O_3 0.75\ CuO 0.75 + ZrO_2 1.4$ | IOAP-PM | ca. 115,000 | 70–80 |
| 4. | $AgSnO_2 8.8Bi_2O_3 0.88\ CuO 0.88 + ZrO_2 0.6 + Bi_2O_3 2.4$ | IOAP-PM | ca. 120,000 | 70–80 |

What is claimed is:

1. In a sinter contact material containing silver (Ag), tin oxide ($SnO_2$), bismuth oxide ($Bi_2O_3$), and copper oxide (CuO) and produced from an intraoxidized alloy powder of the metals silver, tin, bismuth, and copper, wherein the tin oxide is contained in parts by weight of 4 to 12% and the ratio of parts by weight of tin oxide to bismuth oxide is between 8:1 and 12:1 and tin oxide to copper oxide is between 8:1 to 12:1 in the intraoxidized alloy powder, the improvement comprising:

at least zirconium oxide ($ZrO_2$) is present.

2. A sinter contact material wherein the zirconium oxide is present in parts by weight between 0.1 and 5%.

3. A sinter contact material according to claim 2 wherein the zirconium oxide is present in parts by weight between 0.5 and 4%.

4. A sinter contact material according to claim 3 wherein the zirconium oxide is present in parts by weight between 0.5 and 3%.

5. A sinter contact material according to claim 4 wherein the zirconium oxide is present in parts by weight between 0.5 and 2%.

6. A sinter contact material according to claim 1 wherein apart from the bismuth oxide of the intraoxidized alloy powder which forms compound powder particles, additional bismuth oxide is present outside of the compound powder particles.

7. A sinter contact material according to claim 6 wherein the bismuth oxide is present in parts by weight between 0.1 and 5%.

8. A sinter contact material according to claim 7 wherein the bismuth oxide is present in parts by weight between 0.5 and 4%.

9. A sinter contact material according to claim 8 wherein the bismuth oxide is present in parts by weight between 0.5 and 3%.

10. A sinter contact material according to claim 1 wherein the total content of oxides in parts by weight is about 20% maximum.

11. A sinter contact material according to claim 10 wherein the parts by weight of all oxides is about 12%.

12. A sinter contact material according to claim 6 wherein total contents of oxides in parts by weight is about 20% maximum.

13. A sinter contact material according to claim 12 wherein the parts by weight of all oxides is about 12%.

14. A sinter contact material according to claim 7 wherein the zirconium oxide is present in parts by weight between 0.1 and 5%.

15. A sinter contact material according to claim 8 wherein the zirconium oxide is present in parts by weight between 0.5 and 4%.

16. A sinter contact material according to claim 9 wherein the zirconium oxide is present in parts by weight between 0.5 and 3%.

17. A sinter contact material according to claim 9 wherein the zirconium oxide is present in parts by weight between 0.5 and 2%.

18. A sinter contact material according to claim 15 wherein the total content of oxides in parts by weight is about 20% maximum.

19. A sinter contact material according to claim 18 wherein the parts by weight of all oxides is about 12%.

* * * * *